US012096811B2

(12) United States Patent
Michaeloff

(10) Patent No.: US 12,096,811 B2
(45) Date of Patent: Sep. 24, 2024

(54) SPORTSWEAR GARMENT WITH SEAMLESS MULTI-TIERED COMPRESSION WAISTBAND

(71) Applicant: Wilson Sporting Goods Co., Chicago, IL (US)

(72) Inventor: Joelle Michaeloff, Philadelphia, PA (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 17/749,488

(22) Filed: May 20, 2022

(65) Prior Publication Data

US 2023/0371630 A1 Nov. 23, 2023

(51) Int. Cl.

| | |
|---|---|
| ***A41F 9/00*** | (2006.01) |
| ***A41D 1/14*** | (2006.01) |
| ***A41D 13/00*** | (2006.01) |

(52) U.S. Cl.

CPC ..... *A41F 9/00* (2013.01); *A41D 1/14* (2013.01); *A41D 13/0017* (2013.01); *A41D 2600/10* (2013.01)

(58) Field of Classification Search

CPC . A41D 1/08; A41D 1/089; A41D 1/14; A41D 1/22; A41D 13/0015; A41D 13/0017; A41D 31/18; A41D 31/185; A41D 2400/32; A41D 2400/38; A41D 2500/10; A41D 2600/10; A41C 1/003; A41C 1/006; A41C 1/02; A41C 1/08; A41C 1/10; A41B 9/14; A41F 9/00

USPC ..... 2/220, 237, 221

See application file for complete search history.

(56) References Cited

U.S. PATENT DOCUMENTS

| | | | | |
|---|---|---|---|---|
| 5,052,058 | A * | 10/1991 | Mueller | A41D 1/089 66/177 |
| 5,636,386 | A * | 6/1997 | Salamone | A41D 1/14 2/243.1 |
| 9,044,051 | B1 * | 6/2015 | Rydman | A41D 1/062 |
| 9,717,282 | B1 * | 8/2017 | Hays | A41D 1/00 |
| 11,213,082 | B1 * | 1/2022 | Yang | A41D 1/08 |
| 2004/0216218 | A1 * | 11/2004 | McCarthy | A41D 1/089 2/228 |
| 2006/0174963 | A1 * | 8/2006 | Shannon | A41B 17/00 139/421 |
| 2007/0149093 | A1 * | 6/2007 | Lutz | A41C 3/00 450/1 |

(Continued)

*Primary Examiner* — Heather Mangine
*Assistant Examiner* — Matthew R Marchewka
(74) *Attorney, Agent, or Firm* — Terence P. O'Brien

(57) ABSTRACT

A tennis garment includes a seamless tubular waistband including a top end and a bottom end, a liner short coupled to the waistband, and a skirt coupled to one or both of the waistband and the liner short. The waistband includes at least first, second and third compression regions between the top end and the bottom end. The first, second and third compression regions have first, second and third compression levels, respectively. The first compression region is at or adjacent to the top end. The third compression region is positioned toward the bottom end, and the second compression region being positioned between the first and third compression regions. The third compression level is greater than the second compression level, and the second compression level is greater than the first compression level.

15 Claims, 11 Drawing Sheets

(56) References Cited

U.S. PATENT DOCUMENTS

| | | | | |
|---|---|---|---|---|
| 2008/0230580 | A1* | 9/2008 | Rothschild | A41D 13/0015 224/660 |
| 2016/0007662 | A1* | 1/2016 | Powell | A41D 1/089 2/228 |
| 2016/0106161 | A1* | 4/2016 | Hedrick | A41D 1/065 2/212 |
| 2021/0205113 | A1* | 7/2021 | Wong | A61F 5/03 |
| 2021/0235792 | A1* | 8/2021 | Rea | A41D 27/201 |
| 2022/0018043 | A1* | 1/2022 | Kimura | D06M 15/643 |
| 2022/0047022 | A1* | 2/2022 | Almog | D04B 1/24 |
| 2022/0273059 | A1* | 9/2022 | Baschak | A41F 9/00 |

* cited by examiner

SPORTSWEAR GARMENT WITH SEAMLESS MULTI-TIERED COMPRESSION WAISTBAND

FIELD OF THE INVENTION

The present invention relates to a sportswear garment with an improved waistband.

BACKGROUND OF THE INVENTION

Tennis skirts, leggings and other sportswear articles are well-known. They are used for playing sports and also for day-to-day activities. Comfort and functionality are key aspects of such garments. Wearers of such garments seek garments that enhance their appearance and ability to participate in daily activities and/or sporting events in comfort and style. One drawback of many existing sportswear garments such as tennis skirts or leggings, is that the waistband on such articles can cause a "muffin-top" appearance for many wearers. Muffin-top is a roll of excess tissue from a person's waist that can hang out or over a garment with a tight waistband.

Accordingly, a need exists for an improved garment that is provides all the functionality desired for sportswear garments but reduces the likelihood of the occurrence of muffin top. It would also be advantageous to provide a garment configured for reducing the likelihood of muffin top and that retains a stylish, pleasing aesthetic.

SUMMARY OF THE INVENTION

The present invention presents a tennis garment including a seamless tubular waistband including a top end and a bottom end, a liner short coupled to the waistband, and a skirt coupled to one or both of the waistband and the liner short. The waistband includes at least first, second and third compression regions between the top end and the bottom end. The first, second and third compression regions have first, second and third compression levels, respectively. The first compression region is at or adjacent to the top end. The third compression region is positioned toward the bottom end, and the second compression region is positioned between the first and third compression regions. The third compression level is greater than the second compression level, and the second compression level is greater than the first compression level.

According to a principal aspect of a preferred form of the invention, a sportswear garment includes a seamless tubular waistband including a top end and a bottom end, and leggings coupled to the waistband. The waistband includes at least first, second and third compression regions between the top end and the bottom end. The first, second and third compression regions have first, second and third compression levels, respectively. The first compression region is at or adjacent to the top end. The third compression region is positioned toward the bottom end, and the second compression region is positioned between the first and third compression regions. The third compression level is greater than the second compression level, and the second compression level is greater than the first compression level.

This invention will become more fully understood from the following detailed description, taken in conjunction with the accompanying drawings described herein below, and wherein like reference numerals refer to like parts.

Figure 1:
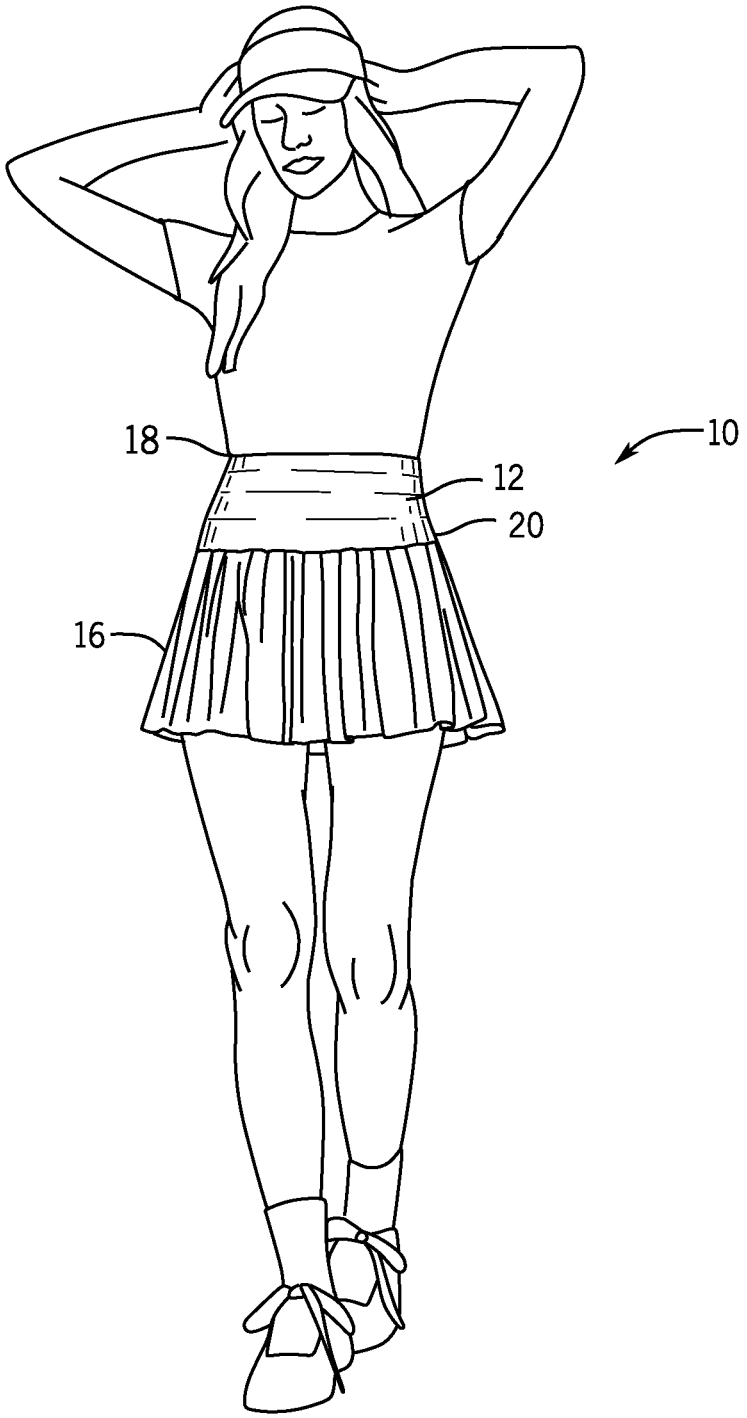
FIG. 1 is a front perspective view of a person wearing a tennis skirt constructed in accordance with one implementation of the present invention.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF THE INVENTION

Figure 2:
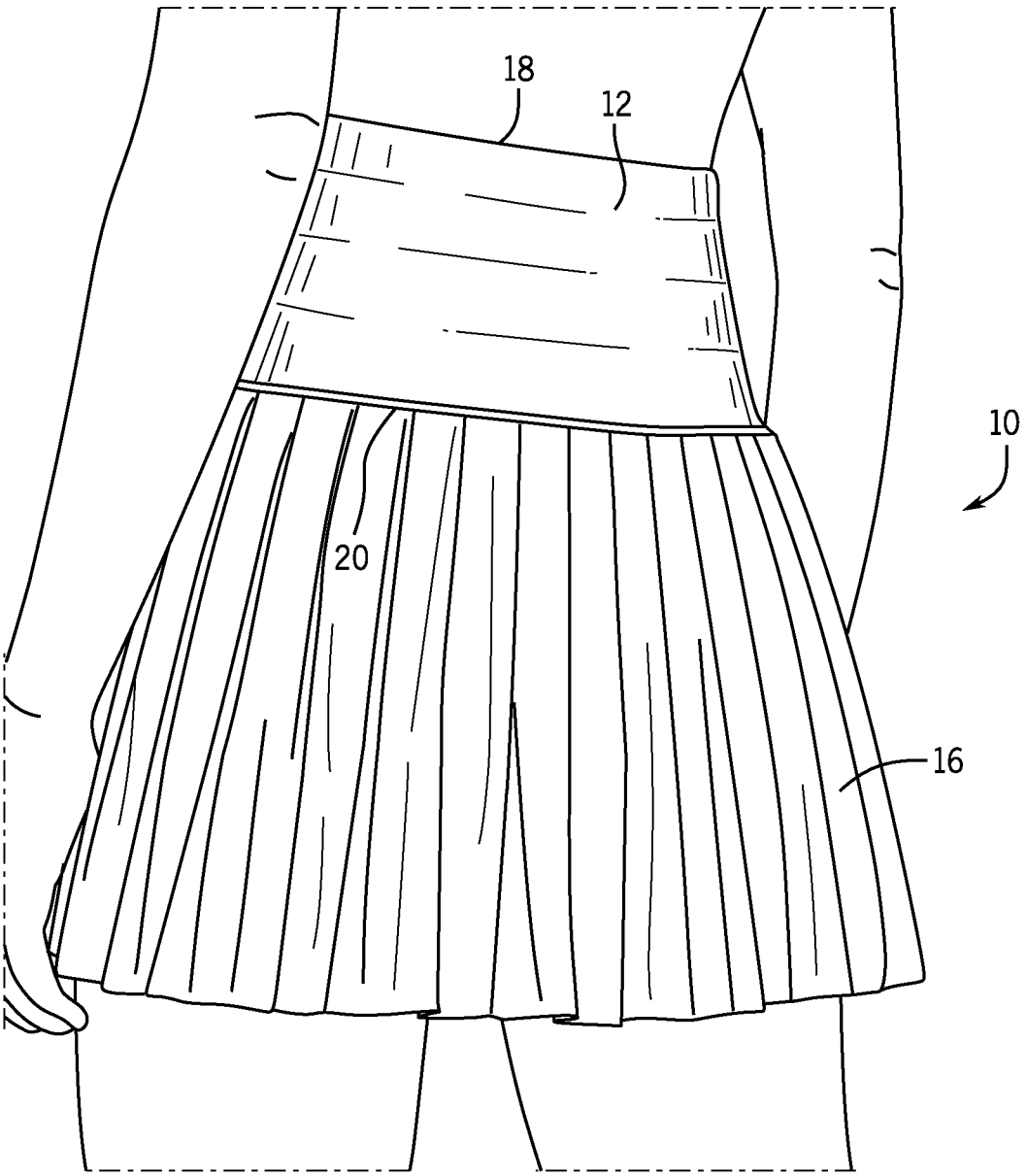
FIG. 2 is a rear perspective view of the tennis skirt of FIG. 1.
Figure 3:
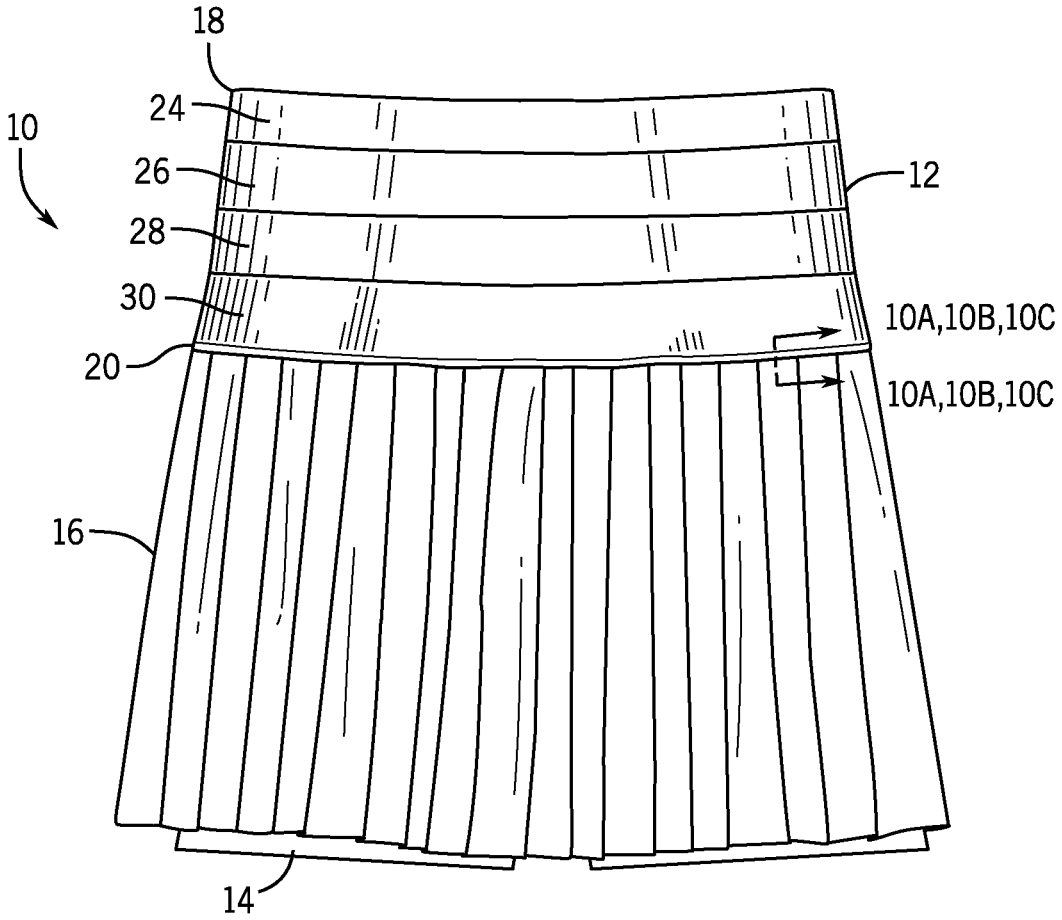
FIG. 3 is a front view of the tennis skirt of FIG. 1.

Referring to FIGS. 1 through 3, a sportwear garment in the form of a tennis skirt is generally indicated as item 10 is illustrated. The sportswear garment 10 of FIGS. 1 and 2 is configured as a tennis skirt. The present invention can also be directly applicable to other garments such as, for example, other forms of skirts, leggings and pants. Referring to FIGS. 1-3 and 9, the tennis skirt 10 includes a seamless tubular waistband 12, a liner short 14, and a skirt 16.

The tennis skirt 10 can be used for playing tennis, playing other sports, or engaging in any casual wear activity. For purposes of this disclosure, the term "compression level" with respect to regions of a tubular seamless waistband refers to the amount or degree in which a particular tubular region of the waistband resists outward expansion. In other words, the tubular waistband when worn by a wearer has an inside area that generally matches the size of the waist of the wearer. The compression level is measure of the degree in which regions of the waistband resist outward expansion of the inside area. Another description of the multiple compression levels in the waistband is that the waistband is a multi-modulus waistband. The waistband has separate regions having different compression levels and each region has a separate modulus of elasticity. In this case, each region of the tubular seamless waistband is essentially a separate knitted fabric structure having a separate modulus of elasticity. The knitted fabric structure of each region of the waistband has separate or different level of resistance to non-permanent, or elastic, deformation. For purposes of this disclosure, the term "tennis skirt" refers to one-piece sportswear garment extending downward from the waist and including a liner short, and the term "skirt" alone shall mean part of a garment that extends downward from the waist. For purposes of this disclosure, the term "coupled" shall mean the joining of two members directly or indirectly to one another. Such joining may be stationary in nature or movable in nature. Such joining may be achieved with the two members, or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members Referring to FIGS. 2 through 4, the waistband 12 is shown in greater detail. The waistband 12 is a seamless tubular elastic knitted fabric structure. In one implementation, the knitted fabric structure is formed from a single fabric, such as a fabric formed of a combination of nylon and a polyether-polyurea copolymer (e.g., Spandex®). In other implementations, the nylon and polyether-polyurea copolymer fabrics generally referred to as spandex [Spandex®] fabric can be formed of other variations of nylon and spandex [Spandex®]. In other implementations, other materials can be used, such as, for example, other woven and unwoven fabrics, other knits or textiles, cotton, other synthetic or natural materials, elastic materials, hydrophobic materials, insulating materials, such as polychloroprene (also known as neoprene), rubber, wool, cotton, polyester, elastane, natural fibers, synthetic fibers, para-aramid synthetic fibers such as KEVLAR® fibers, other polymeric materials and combinations thereof.

The waistband 12, when on the sportswear garment such as the tennis skirt 10, has a top end 18 and a bottom end 20 when the tennis skirt 10 is orientated in a normal upright position. Referring to FIGS. 1 through 4, the waistband 12 includes at least three separate compression regions, which provide a waistband with tiered compression from the top end 18 to the bottom end 20. In the waistband of FIGS. 1 through 4, the waistband 12 includes first, second, third and fourth compression regions 24, 26, 28 and 30 between the top end 18 and the bottom end 20. The first compression region 24 is at, or adjacent to, the top end 18. The fourth compression region 30 is positioned at, or adjacent to, the bottom end 20. The second compression region 26 is positioned between the first and third compression regions 24 and 28, and the third compression region 28 is positioned between the second and fourth compression regions 26 and 30. Each of the first, second, third and fourth compression regions 24, 26, 28 and 30 have first, second, third and fourth compression levels, respectively. The fourth compression level that is greater than the third compression level. The third compression level is greater than the second compression level, and the second compression level is greater than the first compression level. The different compression levels of the first, second, third and fourth compression regions 24, 26, 28 and 30 provide for the multi-tiered compression waistband, or the multi-modulus waistband.

Figure 4:
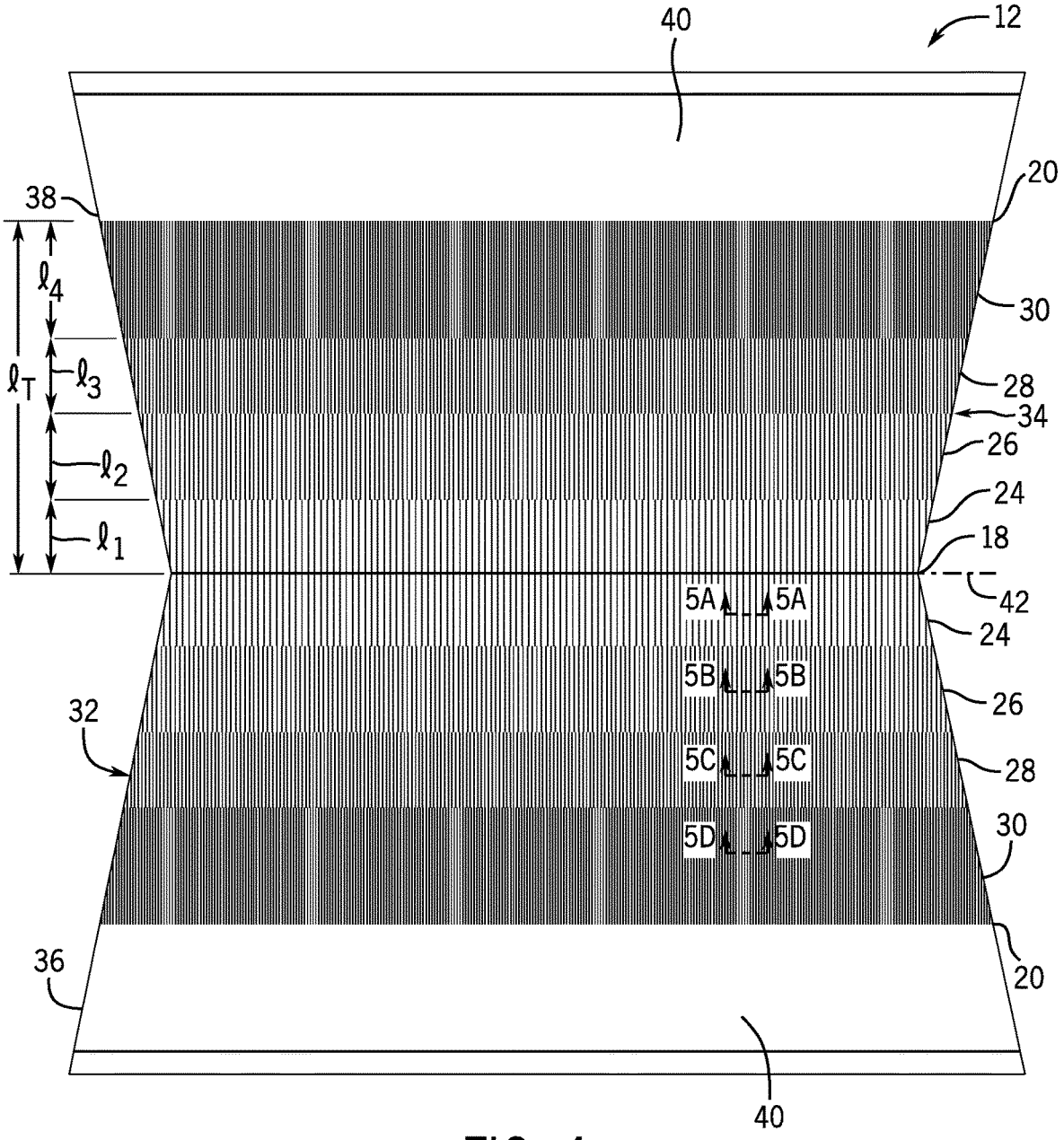
FIG. 4 is a top view of a tubular seamless waistband before assembly into a sportswear garment in accordance with one implementation of the present invention.
Figure 5A:
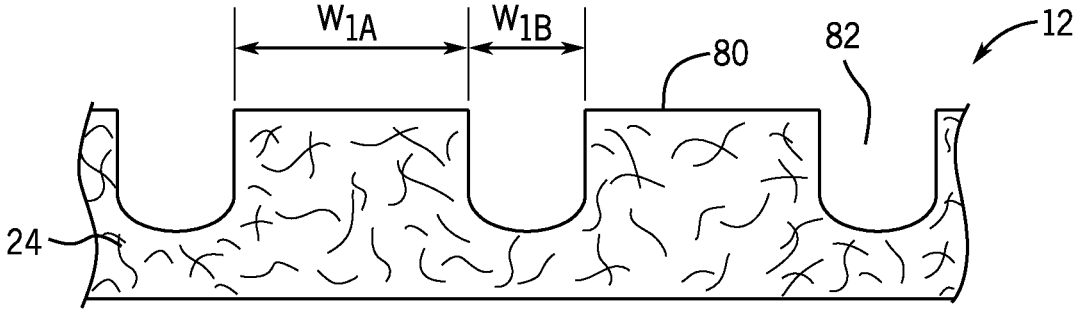
FIGS. 5A, 5B, 5C and 5D are cross-sectional views of four separate regions of the waistband of FIG. 4.
Figure 5B:
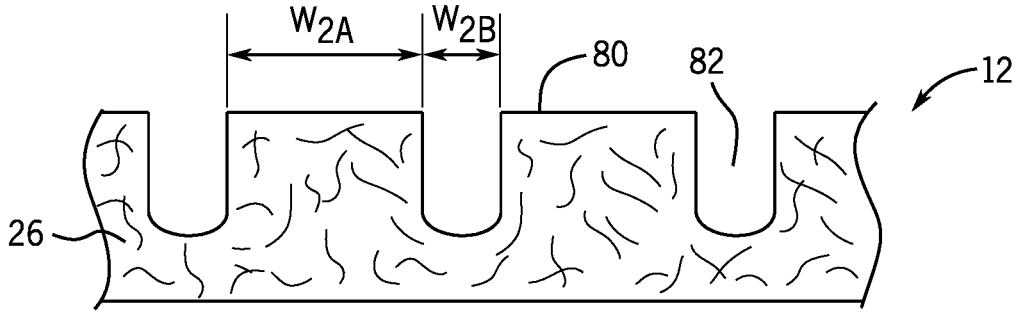
Figure 5C:
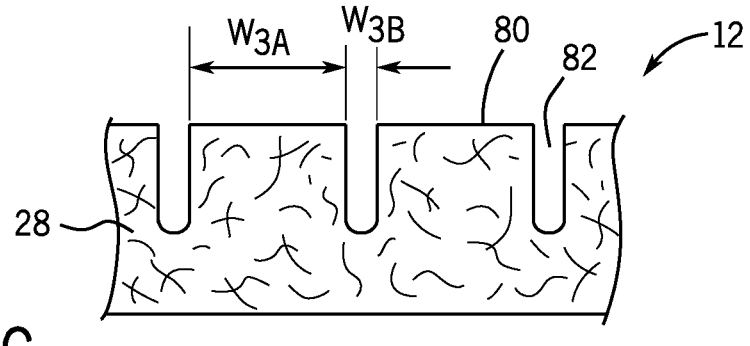
Figure 5D:
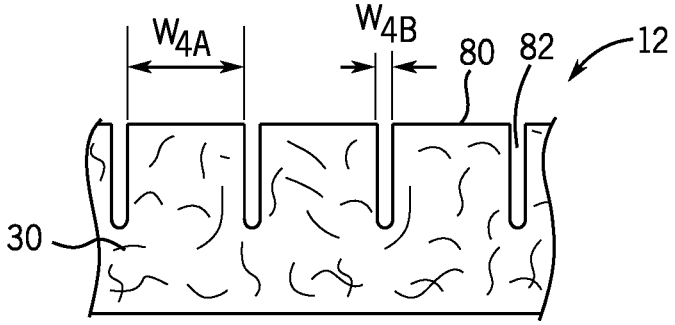
Figure 6:
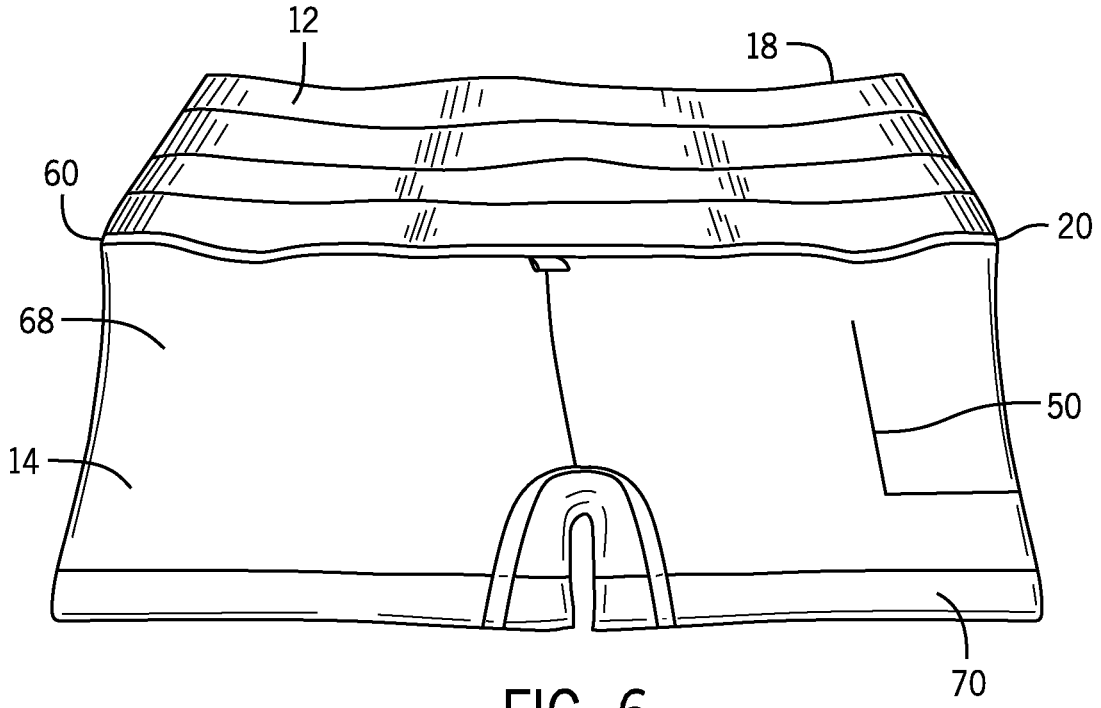
FIG. 6 is a rear perspective view of a waistband and a liner short of the tennis skirt of FIG. 1 shown inside out and without the addition of a pleated skirt.

Referring to FIGS. 4 and 5A through 5D, the first, second, third and fourth compression regions 24, 26, 28 and 30 have different compression levels or different moduli of elasticity. Each of the first, second, third and fourth compression regions 24, 26, 28 and 30 have a knitted fabric structure that includes a plurality of ribs 80 that extend in a generally vertical direction (when the waistband is positioned in an upright position) from the top end 18 of the waistband 12 to the bottom end 20 of the waistband 12. The ribs 80 are spaced apart by a plurality of valleys 82. Referring to FIG. 5A, in one implementation, each of the ribs 80 of compression region 24 has a width, $W_{1A}$, of approximately 1.5 mm and each of the valleys 82 of compression region 24 has a width, $W_{1B}$, that is approximately 0.75 mm. Referring to FIG. 5B, in one implementation, each of the ribs 80 of compression region 24 has a width, $W_{2A}$, of approximately 1.25 mm and each of the valleys 82 of compression region 24 has a width, $W_{2B}$, that is approximately 0.5 mm. Referring to FIG. 5C, in one implementation, each of the ribs 80 of compression region 24 has a width, $W_{3A}$, of approximately 1.0 mm and each of the valleys 82 of compression region 24 has a width, $W_{3B}$, that is approximately 0.2 mm. Referring to FIG. 5D, in one implementation, each of the ribs 80 of compression region 24 has a width, $W_{4A}$, of approximately 0.75 mm and each of the valleys 82 of compression region 24 has a width, $W_{4B}$, that is approximately 0.1 mm. In other implementations, other sizes of ribs and valleys can be used. In still other implementations, one or more of the compression regions can be formed without a ribbed knitted structure. In one implementation, the knitted structure of the fourth compression region 30 has a rib lock stitch structure that provides the highest level of compression. In another implementation, the knitted structure of the first, second and third compression regions 24, 26 and 28 can have a drop needle rib stitch structure. The knitted structure of the first, second and third compression regions 24, 26 and 28 can also have a flat back rib stitch structure. In another implementation, the knitted structure of the first, second and third compression regions 24, 26 and 28 can also have a rib lock stitch structure.

Referring to FIG. 4, the waistband 12 has a total height $l_T$ measured in a direction from the top end 18 to the bottom end 20 is within the range of 10 to 16 centimeters (cm). In another implementation, total height $l_T$ measured in a direction from the top end 18 to the bottom end 20 is within the range of 12 to 15 cm. In another implementation, the total height $l_T$ is within the range of 13 to 14.5 cm. Additionally, the first, second, third and fourth compression regions 24, 26, 28 and 30 have first, second, third and fourth heights $l_1$, $l_2$, $l_3$ and $l_4$, respectively. The first, second, third and fourth heights $l_1$, $l_2$, $l_3$ and $l_4$ are also measured in a direction from the top end 18 to the bottom end 20 of the waistband 12. In one implementation, each the first, second, third and fourth heights $l_1$, $l_2$, $l_3$ and $l_4$ are each within the range 2 to 6 cm. In another implementation, the first, second and third heights $l_1$, $l_2$ and $l_3$ can each be within the range 2.5 to 4 cm, and the fourth height $l_4$ can be within the range of 3 to 6 cm. In one implementation, the first height $l_1$ is approximately 3 cm, the second height $l_2$ is approximately 3.5 cm, the third height $l_3$ is approximately 3.2 cm, and the fourth height $l_4$ is approximately 4.8 cm. In another implementation, the first height $l_1$ can be approximately 4.6 cm, the second height $l_2$ can be approximately 5.1 cm, and the third height $l_3$ can be approximately 4.8 cm. In other implementations, the first, second, third and fourth heights $l_1$, $l_2$, $l_3$ and $l_4$ can have other heights.

In one implementation, the waistband 12 has an inner portion 32 and an outer portion 34. The inner and outer portions 32 and 34 include first and second edges 36 and 38, respectively. When assembled, the outer portion 34 of the tubular waistband 12 is folded, or otherwise positioned, over the inner portion 32 forming a fold line 42. The first edge 36 of the inner portion 32 of the tubular waistband 12 is aligned with the second edge 38 of the second portion 34 to form the bottom end 20 of the waistband 12 for coupling to the liner short 14 and to the skirt 16. Referring to FIG. 4, the waistband 12 can further include seam allowance regions 40 that are used in producing the assembled product and most of the seam allowance regions 40 are removed during assembly of the tennis skirt 10.

Referring to FIGS. 6 through 9, the liner short 14 is shown in greater detail. The liner short 14 an elastic short pant that is formed of an elastic polymeric material, such as, for example, nylon, polyether-polyurea copolymer fabrics generally referred to as spandex, other woven and unwoven fabrics, knits or textiles, cotton, other synthetic or natural materials, elastic materials, hydrophobic materials, insulating materials, such as polychloroprene (also known as neoprene), rubber, wool, cotton, polyester, elastane, natural fibers, synthetic fibers, other polymeric materials and combinations thereof. The liner short 14 includes a waist region 68 and a pair of legs 70. The liner pant 14 is coupled to the waistband 12 at the lower end 20 of the waistband 12. In one implementation, the liner pant 14 is stitched to the waistband 12. In another implementation, the liner pant 14 is stitched to the skirt 16 and/or to the liner pant 14.

Figure 7:
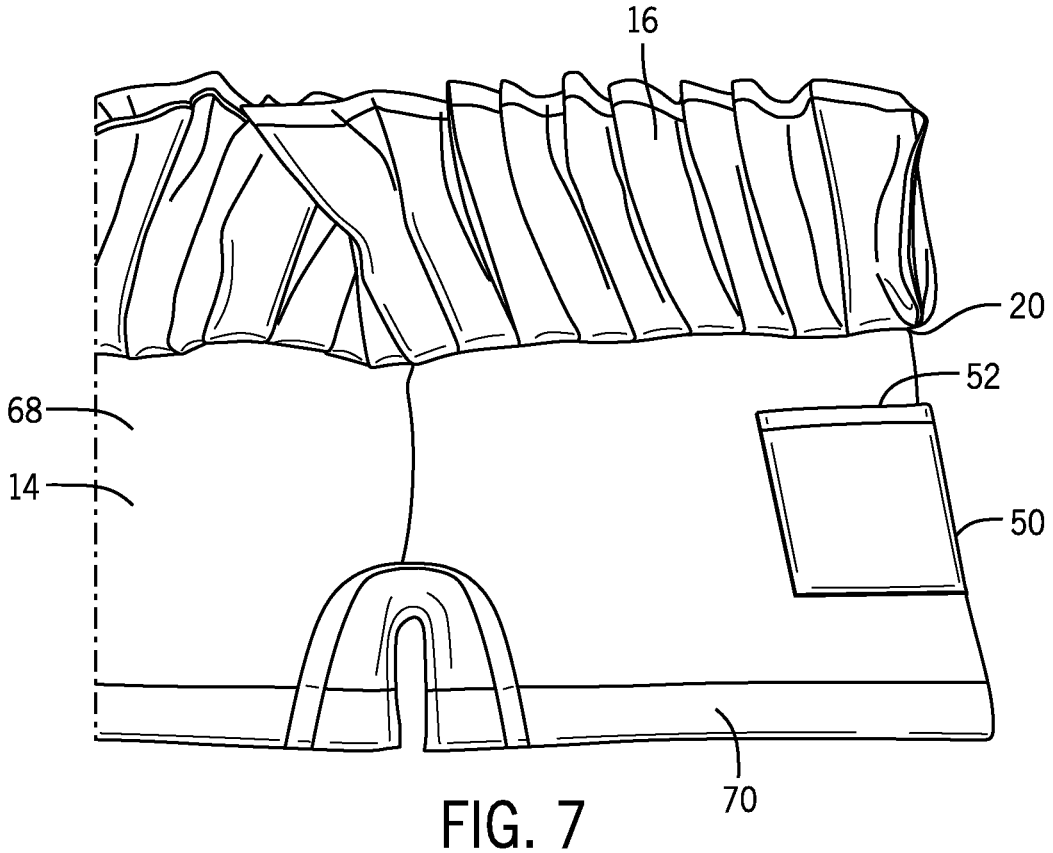
FIG. 7 is a front perspective view of the tennis skirt of FIG. 1, shown with the pleated skirt positioned upward and covering the waistband.
Figure 8:
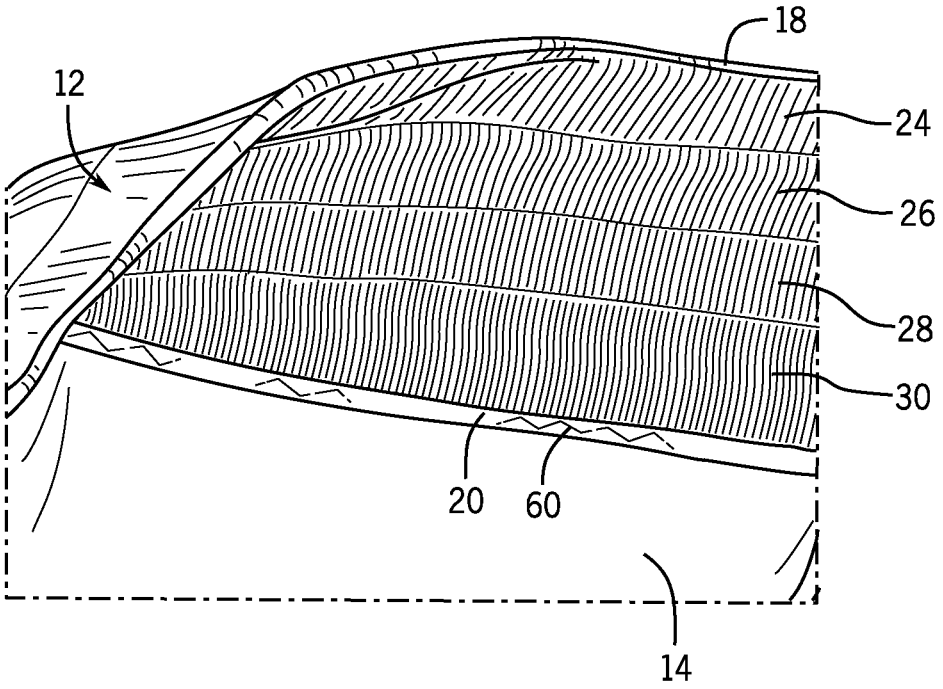
FIG. 8 is a front, top perspective view of a portion of the waistband of the tennis skirt of FIG. 1.
Figure 9:
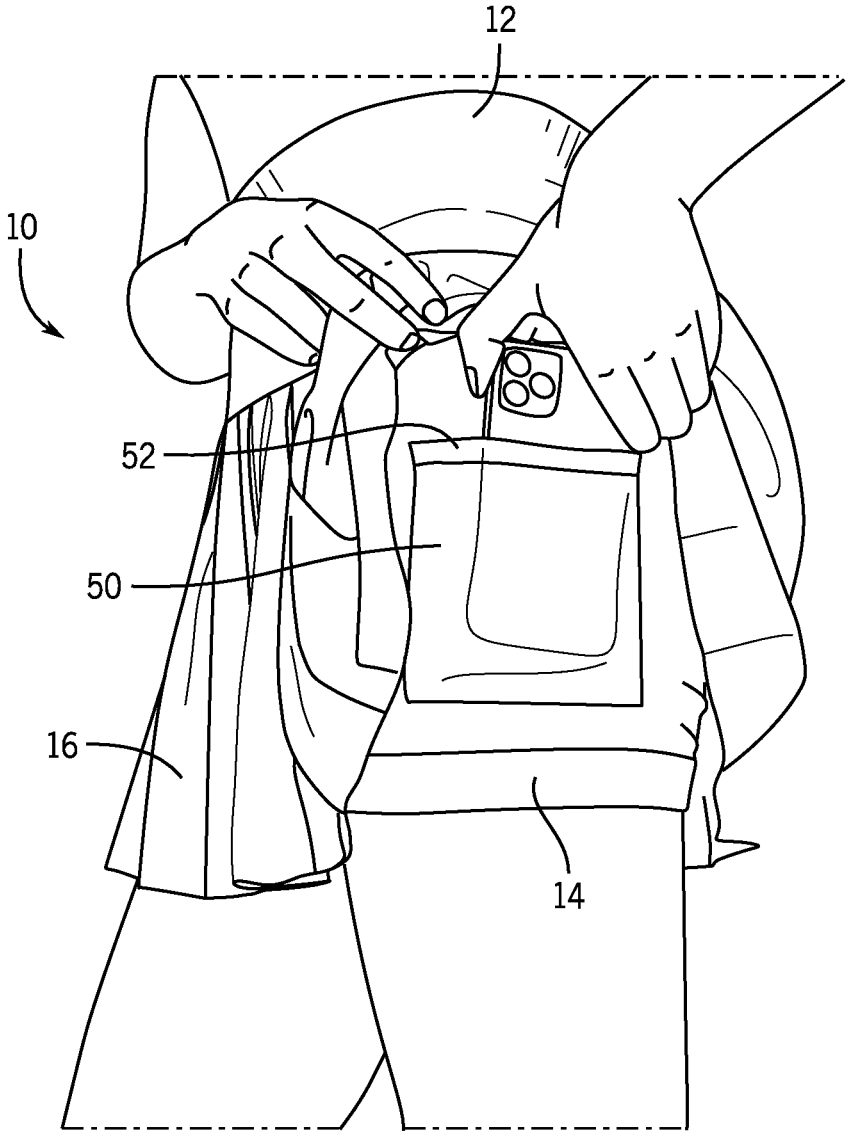
FIG. 9 is a side perspective view of the tennis skirt of FIG. 1 shown with the wearer accessing a pocket of the liner short.

Referring to FIGS. 7 and 9, the liner pant 14 can also include one or more pockets 50. The pocket 50 can include a lower edge, and first and second side edges. The first and second side edges of the pocket 52 can form a mouth 52 or opening at the top of the pocket 50. In one implementation, the pocket 50 is stitched to the liner pant 14. In other implementations, the pocket 50 can be attached to liner pant 14 through other fastening means, such as, for example, one or more adhesives, thermal bonding, pressing, rivets, stitchings, or combinations thereof. The pocket 50 can be formed of the same or similar materials as the liner pant 14. The pocket 50 is sized to receive objects, such as a cellphone (FIG. 9) or one or more tennis balls.

Referring to FIGS. 1-3, 7 and 9, the skirt 16 is coupled to the lower end 20 of the waistband 12. In one implementation, the skirt 16 is coupled to the waistband 12 via one or more stitchings. In one implementation, the skirt 16 is sized to hang from the lower end 20 of the waistband 12 and substantially extend over the liner short 14. In one implementation, the skirt 16 has a length that is substantially the same as the liner short 14. In another implementation, the skirt 16 can be slightly longer than the length of the liner short 14. In other implementations, the skirt 16 can have other lengths. In one implementation, the skirt 16 is pleated. In other implementations, the skirt can be unpleated or have other pleated designs.

Figure 10A:
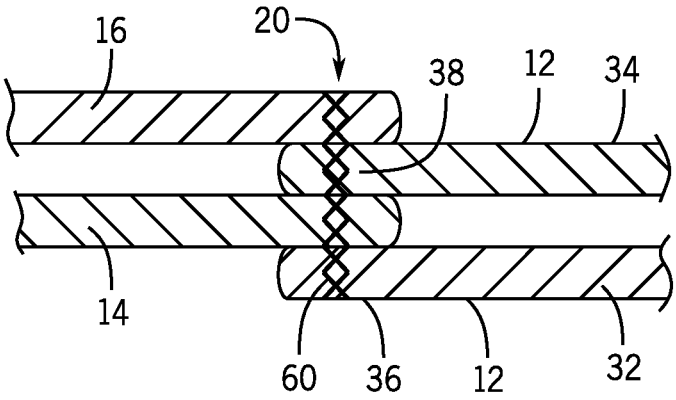
FIGS. 10A, 10B and 10C are cross-sectional views of the tennis skirt of FIG. 1 illustrating implementations of the stitching of the liner short and the skirt to the waistband.
Figure 10B:
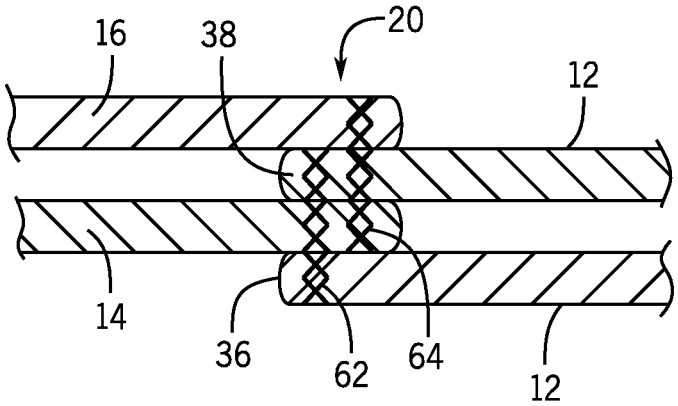
Figure 10C:
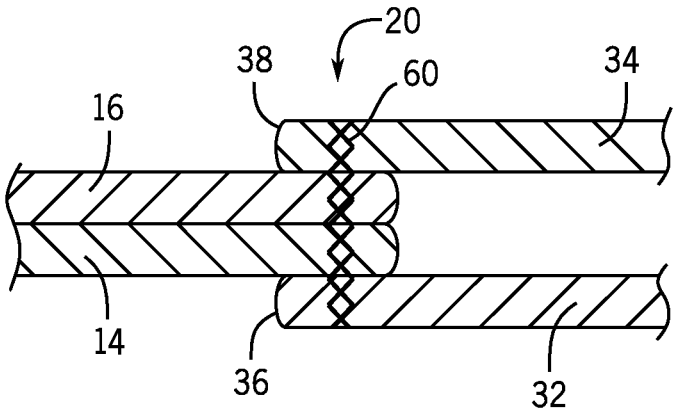

FIGS. 10A, 10B and 10C illustrate the example implementations of the coupling of the waistband 12 to the liner short 14 and to the skirt 16. Referring to FIG. 10A, in one implementation, the liner short 14 can be inserted between the inner and outer portions 32 and 34 of the waistband 12 at the first and second edges 36 and 38. Additionally, the top edge of the skirt 16 can be positioned outside of the outer portion 34 of the waistband 12 and the assembly of layers can be stitched together through a stitching 60. Referring to FIG. 10B, in another implementation, the liner short 14 can be inserted between the inner and outer portions 32 and 34 of the waistband 12 at the first and second edges 36 and 38. The top edge of the skirt 16 can then be positioned outside of the outer portion 34 of the waistband 12 and the assembly of layers can be stitched together through two stitchings 62 and 64, wherein the stitching 62 can extend through the inner and outer portions of the waistband 12 and the liner short 14, and the stitching 64 can extend through the skirt 16, the outer portion 34 of the waistband 12, and optionally the liner short 14. Referring to FIG. 10C, in another implementation, the top edge of the skirt 16 and the top edge of the liner short 14 can both be inserted between the first and second edges 36 and 38 of the inner and outer portions of the waistband 12, and then the assembly of layers can be stitched together with the stitching 60. In other implementations, other combinations of layering of the inner and outer portions of the waistband 12, the liner short 14 and the skirt 16 can be used along with one, two or more stitches or other bonding methods.

Figure 11:
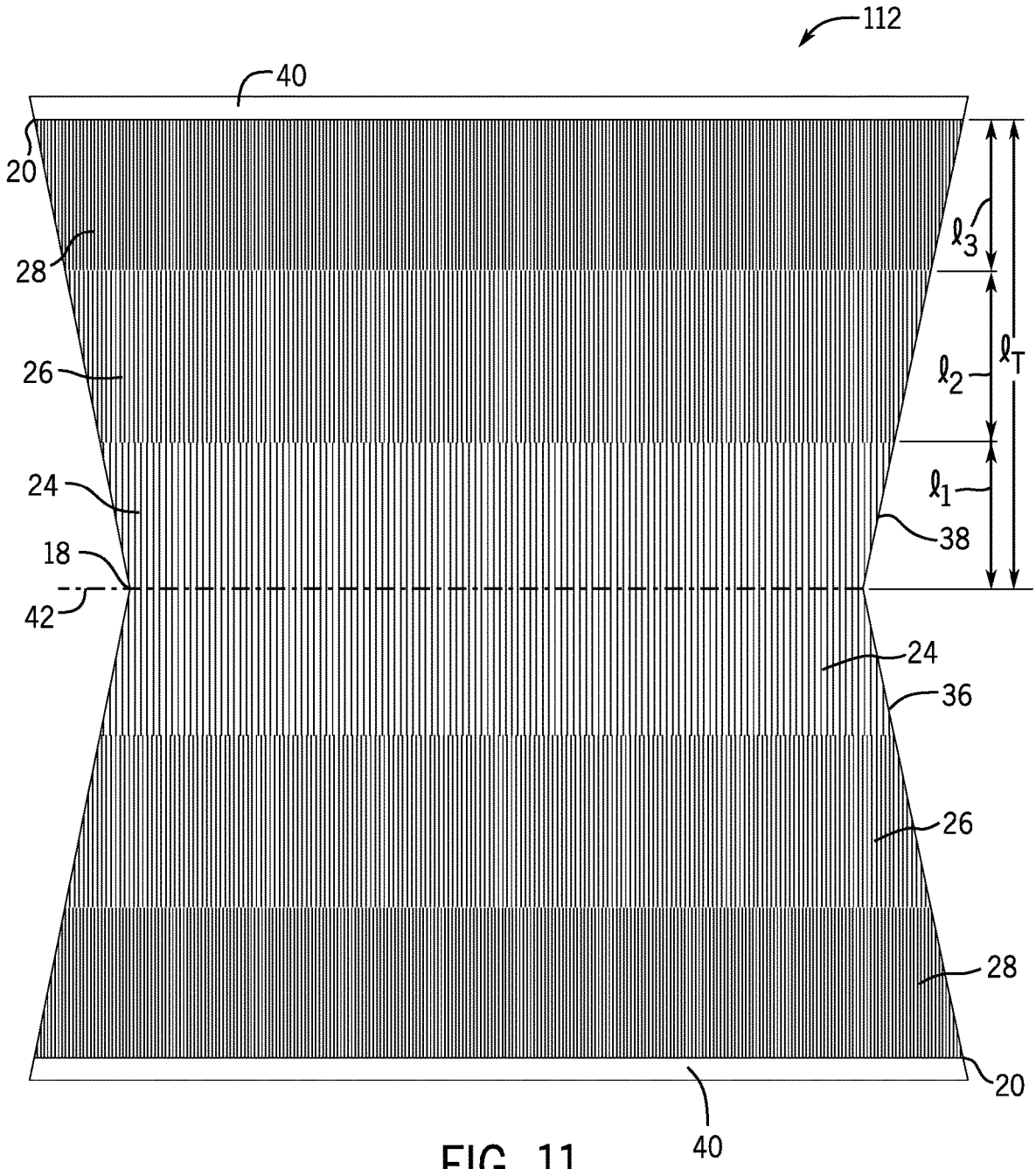
FIG. 11 is a top view of a tubular seamless waistband before assembly into a sportswear garment in accordance with another implementation of the present invention.

Referring to FIG. 11, in another implementation, another implementation of a waistband under the present invention is illustrated, waistband 112. Waistband 112 a tubular, seamless, multi-tiered compression waistband that is substantially the same as the waistband 12 of FIG. 4, except that waistband 112 is formed with only three compression regions, the first, second and third compression regions 24, 26 and 28. Like the waistband 12 of FIG. 4, the first, second and third compression regions 24, 26 and 28 of the waistband 112 has first, second and third compression levels, respectively. The first compression region 24 is at, or adjacent to, the top end. The third compression region 28 is positioned at, or toward, the bottom end, and the second compression region 26 is positioned between the first and third compression regions 24 and 28. The third compression level is greater than the second compression level, and the second compression level is greater than the first compression level. In other implementations, the waistband can be formed with 2, 5, 6 or more compression regions. The waistband 112 also includes multi-tiered compression characteristics.

Figure 12:
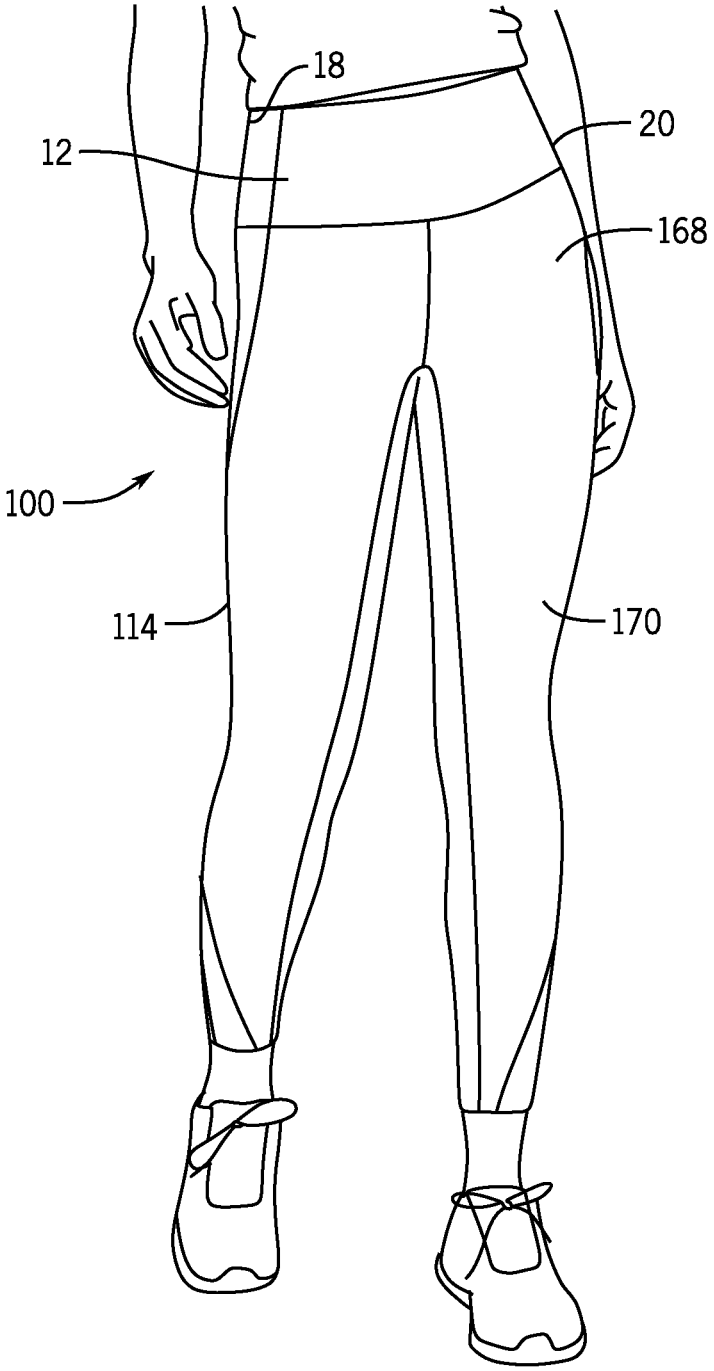
FIG. 12 is a front perspective view of a person wearing leggings constructed in accordance with another implementation of the present invention.

Referring to FIG. 12, another implementation of a sportswear garment incorporating the present invention is illustrated. The sportswear garment of FIG. 12 is a pair of leggings 100 having the waistband 12 coupled to a waist region 168 and a pair of legs 170. The waistband 12 of FIG. 12 is the same as the waistband of FIG. 1.

The waistband 12, 112 of the sportswear garments 10, 110 provide significant advantages of existing waistbands. The waistband 12, 112 provides tiered compression that inhibits the occurrence of muffin top for the wearer. The lesser compression level(s) toward the top end 18, or first and second compression regions, enable the sportswear garment to comfortable fit the wearer and allow the wearer to engage in all desired sports, casual or recreational activities while inhibiting the occurrence of a muffin top appearance for the wearer. The tiered compression, multi-modulus fabric knit structure of the waistband 12, 112 also provides a desirable level of compression and comfort for the wearer. The waistband 12, 112 serves to enhance the wearer's appearance while providing exceptional freedom of movement and durability for the wearer.

Although the present disclosure has been described with reference to example implementations, workers skilled in the art will recognize that changes may be made in form and detail without departing from the spirit and scope of the claimed subject matter. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure. Accordingly, it will be intended to include all such alternatives, modifications and variations set forth within the spirit and scope of the appended claims. Unless a term is specifically and overtly defined in this specification, the terminology used in the present specification is intended to be interpreted in its broadest reasonable manner, even though may be used conjunction with the description of certain specific embodiments of the present invention.

What is claimed is:

1. A tennis garment comprising:

a seamless tubular waistband including a top end and a bottom end, the waistband including at least first, second and third compression regions between the top end and the bottom end, the at least first, second and third compression regions having first, second and third compression levels, respectively, the first compression region being at or adjacent to the top end, the third compression region being positioned toward the bottom end, and the second compression region being positioned between the first and third compression regions, the third compression level being greater than the second compression level, and the second compression level being greater than the first compression level; the waistband including a first portion extending over a second portion, the first and second portions having first and second edge regions, respectively, the first and second edge regions being aligned to form the bottom end of the seamless tubular waistband, a liner short being stitched to at least the first edge region of the first portion of the waistband; and a skirt coupled to at least one of the waistband and the liner short, the skirt being stitched to the second edge region of the second portion of the waistband.

2. The garment of claim 1, wherein the skirt is pleated with vertically extending pleats.

3. The garment of claim 1, wherein the skirt extends substantially over the liner short.

4. The garment of claim 1, wherein the liner short is coupled to the bottom end of the waistband through stitching.

5. The garment of claim 1, wherein the skirt is coupled to the bottom end of the waistband through stitching.

6. The garment of claim 1, wherein the liner short includes at least one pocket.

7. The garment of claim 1, wherein the at least first, second and third compression regions are first, second, third and fourth compression regions.

8. The garment of claim 7, wherein the fourth compression region is positioned between the third compression region and the bottom end, wherein the fourth compression region has a fourth compression level that is greater than the third compression level.

9. The garment of claim 1, wherein the waistband has a total height measured in a direction from the top end to the bottom end of the waist band within the range of 10 to 15 centimeters.

10. The garment of claim 9, wherein the first, second and third compression regions have first, second and third heights, respectively, measured in a direction from the top end to the bottom end of the waistband, wherein the first, second and third heights are each within the range 2 to 5 cm.

11. The garment of claim 1, wherein the first, second, third and fourth compression regions have first, second, third and fourth heights, respectively, measured in a direction from the top end to the bottom end of the waistband, wherein the first, second and third heights are each within the range 2.5 to 4 cm, and wherein the fourth height is within the range of 3 to 6 cm.

12. The garment of claim 1, wherein the first and second edge regions of the first and second portions of the waistband, the liner short and the skirt are connected by a first stitching.

13. The garment of claim 1, wherein the first and second edge regions of the first and second portions of the waistband and the liner short are connected by a first stitching, and wherein the second edge region of the second portion is stitched to the skirt by a second stitching.

14. The garment of claim 1, wherein the first, second and third compression regions include first, second and third sets of ribs and valleys, respectively, wherein the first, second and third sets of ribs and valleys define first, second and third valley widths, and wherein the first valley widths are different than the second and third valley widths.

15. The garment of claim 1, wherein the first, second and third compression regions includes first, second and third sets of ribs and valleys, respectively, wherein the top end of the waistband defines a top plane, and wherein the first, second and third sets of ribs and valleys extend in a direction that is perpendicular from the top plane.

* * * * *